US006153885A

United States Patent [19]

Kendall

[11] Patent Number: 6,153,885

[45] Date of Patent: Nov. 28, 2000

[54] TOROIDAL CHARGED PARTICLE DEFLECTOR WITH HIGH MECHANICAL STABILITY AND ACCURACY

[75] Inventor: Rodney Arthur Kendall, Ridgefield, Conn.

[73] Assignee: Nikon Corporation, Tokyo, Japan

[21] Appl. No.: 09/324,899

[22] Filed: Jun. 3, 1999

[51] Int. Cl.[7] ..... H01J 49/20

[52] U.S. Cl. ..... 250/396 ML; 250/396 R

[58] Field of Search ..... 250/396 ML, 396 R, 250/492.2; 29/602.1; 335/213, 210

[56] References Cited

U.S. PATENT DOCUMENTS

| | | | |
|---|---|---|---|
| 4,251,728 | 2/1981 | Pfeiffer et al. | 250/396 R |
| 4,251,790 | 2/1981 | Lucas | 335/213 |
| 5,631,615 | 5/1997 | Messick et al. | 335/213 |
| 5,994,703 | 11/1999 | Arai | 250/396 ML |
| 5,994,704 | 11/1999 | Nakasuji | 250/396 ML |

*Primary Examiner*—Kiet T. Nguyen
*Attorney, Agent, or Firm*—Graham S. Jones, II

[57] ABSTRACT

A semiconductor manufacturing tool for charged particle lithography systems such as an EBPS comprises a magnetic deflector with a hub comprising a cylinder mounted on flange. The hub has an opening for a particle beam. Grooves on the surface of the flange at the base of the cylinder and slots in the edge of the cylinder support several deflection coil vanes. Each of the vanes is formed of substrate comprising a thin plate which has a left surface and a right surface. Complementary electrical coils are wound as a planar spirals on the left surface and on the right surface of the vanes with a via connection through the plate interconnecting the coils. The series connected, spiral coils are patterned as mirror images so that the magnetic fields from the coils are additive. To accommodate vanes carrying large currents, the plate is quartz and complementary copper conductor spirals are bonded to the sides of the quartz plate.

25 Claims, 9 Drawing Sheets

TOROIDAL CHARGED PARTICLE DEFLECTOR WITH HIGH MECHANICAL STABILITY AND ACCURACY

CROSS-REFERENCE TO RELATED APPLICATION

This application is related to copending U.S. patent application Ser. No. 09/325,162, filed Jun. 3, 1999 by D. Pinckney and R. Kendall for "Fabrication Method of High Precision, Thermally Stable Electromagnetic Coil Vanes" (hereinafter referred to as Pinckney et al.) and assigned to a common assignee herewith. The subject matter disclosed in copending Pinckney et al. U.S. patent application Ser. No. 09/325,162, filed Jun. 3, 1999 is incorporated herein by reference.

BACKGROUND OF THE INVENTION

1. Field of the Invention

This invention relates to Charged Particle Beam Projection Systems employed in lithography, and more particularly to deflector coil structures employed in such systems and to methods of manufacture of such coil structures.

2. Description of Related Art

In Charged Particle Beam Systems used for lithography, such as E-beam (electron beam) lithography systems, electromagnetic deflectors are typically used to deflect an E-beam to a desired landing point where it exposes a substrate, e.g a mask, reticle, or wafer to the energy of the E-beam.

One type of deflector in common use is the toroidal deflector comprised of a number of discrete coils arranged radially about a central axis as described in U.S. Pat. No. 5,631,615 by Messick and Senesi for "Free Wound Electromagnetic Deflection Yoke". A deflector assembly of this type is typically referred to as a deflection yoke.

As the integrated circuit industry continues to shrink the requirements of the scale of critical dimensions and tolerances for across-chip-linewidth-variation, the mechanical stability and symmetry of the deflector in an E-beam exposure system becomes critical, if placement errors and optical aberrations are to be avoided.

This is especially true in the evolving field of E-beam projection lithography, often referred to by the acronym EBPS (E-Beam Projection Systems), where large deflection fields require application of large amounts of power to deflection yokes, leading to the dissipation large quantities of heat, which has led to thermal effects. As a result, thermal effects caused by current passing through the coils of deflection yokes cause dimensional changes of coil size and location within the deflector assembly which is a major contributor to the mechanical instability of existing deflection yoke designs. Mechanical changes to the coils result in changes to the magnetic deflection field, which in turn results in placement errors plus aberration errors.

Controlling coil temperatures during the operation of an E-beam exposure system for E-beam lithography is critical in maintaining mechanical stability. Temperature control must be maintained while the power dissipated in the coil varies constantly. To maintain a nearly constant temperature, deflectors often operate in a flow of a liquid coolant such as Fluorinert. This is only partially effective, even with the best coolants, because the coolant can reach only the surface of the coils, and has little influence on the core temperature within the tightly wrapped coils. The result is that the coils continue to expand and contract even when and if the surface temperature is being held constant.

In the prior art, conventionally wound strands of copper wire coils have been used in conjunction with liquid or air cooling, but the mechanical problems described above have not been overcome. This problem is well known in the field of E-beam lithography, yet no adequate solution has been forthcoming, heretofore.

SUMMARY OF THE INVENTION

It is an object of this invention to provide a structure, and method of cooling which works effectively because the coolant is able to make direct contact with surface of each and every individual portion of each wire within the coil, along the length thereof.

Another object of this invention is providing a method of making vanes with coils which are cooled effectively because the coolant can make direct contact with the surface of each and every individual portion of each wire within the coil, along the length thereof.

It is another object of this invention to provide improved accuracy and precision at assembly of parts of a deflector with electromagnetic coils.

A further object of this invention is improved mechanical stability of deflectors with electromagnetic coils during operation.

Still another object of this invention is reduction of optical aberrations moving caused by imperfections in the magnetic fields generated by the deflector.

In accordance with this invention, a semiconductor manufacturing tool for charged particle lithography systems such as an EBPS includes a yoke for a magnetic deflection coil comprising a cylindrical element with an opening for a particle beam. The yoke supports a plurality of deflection coil vanes. Each of the vanes includes a thin substrate which has a left surface and a right surface. Electrical coils are wound as a planar spirals on the left surface and on the right surface of the vanes.

In accordance with this invention, a deflector includes a frame for a magnetic deflection coil comprising a cylinder with an opening adapted to permit a particle beam to pass therethrough towards a target. The frame including a plurality of deflection coil vanes supported on the frame. Each of the vanes includes a thin substrate which has a left surface and a right surface. An electrical coil wound as a planar spiral is formed on at least one of the left surface and the right surface of each of the vanes. Preferably, thin substrate of each of the vanes is composed of a rigid insulating material, e.g. as a low Coefficient of Thermal Expansion (CTE) plate and the electrical coil is composed of copper bonded to the low CTE plate. Preferably electrical coils are formed on both the left surface and the right surface of the substrate; and the substrate comprises a quartz plate, the electrical coil is composed of copper bonded to the quartz plate. Preferably the electrical coils are interconnected by an electrical via connection passing through the quartz plate; and the cylinder is formed on a cylindrical flange, with the opening extending through the cylindrical flange.

A deflector includes a hub for a magnetic deflection coil comprising a cylinder formed on a cylindrical flange, the cylinder and the flange forming an opening adapted to permit a particle beam to pass therethrough towards a target. The hub supports a plurality of deflection coil vanes with each of the vanes including a substrate which has a left surface and a right surface, an electrical coil wound as a planar spiral on the left surface and a complementary electrical coil wound as a planar spiral on the right surface of the vane, and the electrical coils are interconnected.

Preferably, the quartz cylinder has slots manufactured in the exterior of the cylinder and the quartz flange has matching grooves manufactured in the top of the flange for holding the vanes in alignment; the quartz cylinder and the quartz flange are bonded together with an optical adhesive material; and vane coolant holes are formed in the flange juxtaposed with the edges of the vanes.

The coolant holes are formed in the flange juxtaposed with the edges of the vanes and concentric annular rings on the surface of the flange provide space for coolant circulation from the coolant holes to spaces between the flange and the vanes.

A method of manufacture of a semiconductor manufacturing tool for charged particle lithography systems the improvement comprises making a frame for a magnetic deflection coil comprising a cylinder with an opening adapted to permit a particle beam to pass therethrough towards a target, and mounting a plurality of deflection coil vanes supported on the frame with each of the vanes includes a thin substrate which has a left surface and a right surface. Form an electrical coil wound as a planar spiral on at least one of the left surface and the right surface.

The method of manufacture of a semiconductor manufacturing tool for charged particle lithography systems the improvement comprises making a hub for a magnetic deflection coil comprising a tubular cylinder and a coaxially aligned mounting flange by the steps of forming a tubular, quartz cylinder with an opening adapted to permit a particle beam to pass therethrough towards a target and making longitudinal slots in exterior surface of the cylindrical quartz element, and making a hollow, quartz mounting flange with radial grooves on the top surface thereof for accepting the lower edges of deflection vanes. Bond the cylindrical quartz element to the quartz mounting flange with the hollow of the flange below the opening through the tubular cylinder, and align the slots in the exterior surface of the tubular cylinder with the radial grooves for accepting a deflection vane in the aligned grooves.

The method includes mounting a plurality of deflection coil vanes supported on the hub, forming each of the vanes of a thin substrate which has a left surface and a right surface, and forming an electrical coil wound as a planar spiral on at least one of the left surface and the right surface, plus forming coolant holes in the flange juxtaposed with the edges of the vanes.

A semiconductor fabrication method in accordance with this invention comprises a wafer fabrication step, a mask fabrication step, a wafer processing step, and an assembly and inspection step, the method being characterized in that the wafer processing step includes a charged particle exposure apparatus wherein the charged particle exposure apparatus includes a deflector with a yoke for a magnetic deflection coil comprising a cylinder with an opening adapted to permit a particle beam to pass therethrough towards a target, the yoke includes a plurality of deflection coil vanes supported on the yoke, each of the vanes includes a thin substrate which has a left surface and a right surface, and an electrical coil is wound as a planar spiral on at least one of the left surface and the right surface.

A wafer production step is performed including wafer preparation. A mask production step is performed including mask preparation step, a wafer processing step, an assembly step and an inspection step, each step comprising several substeps including steps of wafer processing to achieve a specified finest pattern width and registration limit whereby designed circuit patterns are stacked successively on the wafer and many operative semiconductor chips are formed on the wafer. The wafer processing step comprising a step of thin film formation step wherein dielectric layer for insulation or a metal layer for lead line and for an electrode are formed, an oxidization step to oxidize a thin film or wafer substrate, a lithography step to form a resist pattern to process the thin film or wafer substrate selectively, and a processing step to etch the thin film or wafer substrate and to implant the ion or impurity into the thin film or wafer substrate using the resist pattern as a mask, a resist stripping step to remove the resist from the wafer and chip inspection step, the wafer processing step being repeated as many times as necessary to make semiconductor chip be operable as designed.

A first advantage of this invention is improved accuracy and precision at assembly of parts of a deflector with electromagnetic coils.

A second advantage of this invention is improved mechanical stability of deflectors with electromagnetic coils during operation.

Another advantage of this invention is an EBPS which is accurate for complex images which are deflected substantially within an opening for projection of an image in a reticle.

BRIEF DESCRIPTION OF THE DRAWINGS

The foregoing and other aspects and advantages of this invention are explained and described below with reference to the accompanying drawings, in which.

DESCRIPTION OF THE PREFERRED EMBODIMENT

Figure 1C:
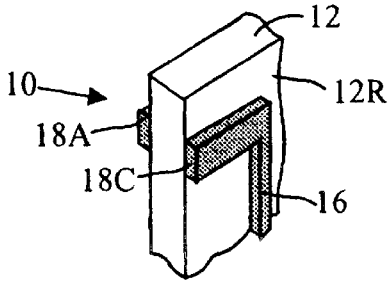
FIG. 1C is a perspective view of the upper left corner of the vane of FIG. 1B shown with a portion of a coil structure seen on the right surface of the vane.
Figure 1A:
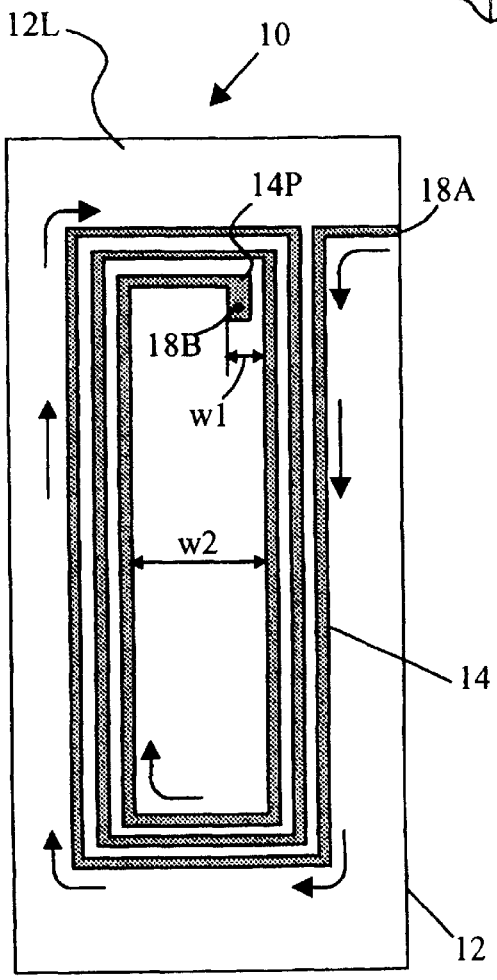
FIG. 1A shows a simplified schematic diagram showing an elevational view of the left side of a vane comprising a plate carrying coil structures for use in a deflector in accordance with this invention.

FIG. 1A shows an elevational view of the left side 12L of a vane 10. FIG. 1A is a simplified schematic diagram. Vane 10 is formed on a thin quartz plate 12. Vane 10 is adapted for use in a deflector in accordance with this invention. Plate 10 has two flat, parallel, planar surfaces including the left side 12L seen in FIG. 1A and the right side 12R of plate 10 which is seen in FIG. 1B.

Plate 12 carries one planar, spiral coil 14 of an electrical conductor which is formed on the left side 12L. Plate 12 also carries another planar, spiral coil 16 of an electrical conductor which is formed on the right side 12R of plate 12.

Figure 1B:
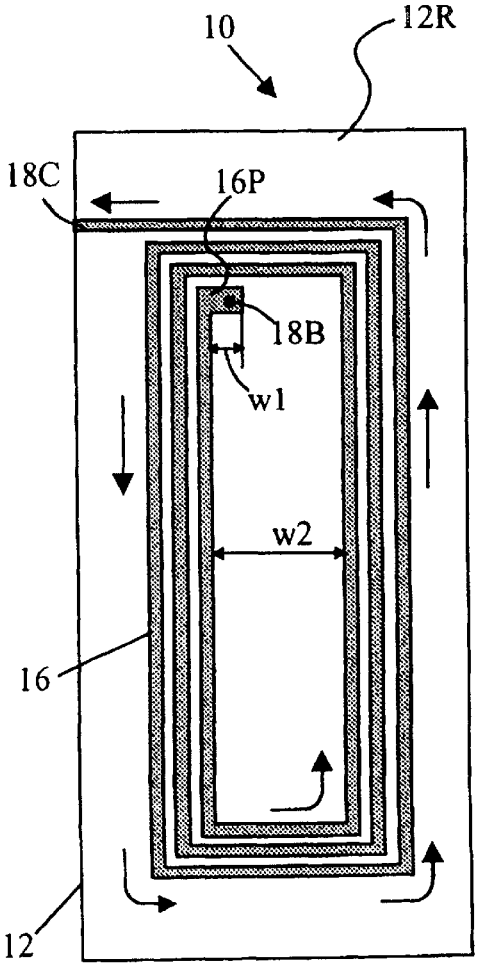
FIG. 1B is a schematic diagram showing an elevational view of the right side of the vane of FIG. 1A.

Referring to FIG. 1B, matching coil 16 is shown formed on the right (opposite) side surface 12R of the thin plate 12 which is superimposed above coil 14 in FIG. 1C. Coil 16 is substantially a mirror image of coil 14, so coils 14 and 16 form a matched pair. Thus, the two coils 14 and 16 are formed on opposite sides of plate 12. Coil 14 is formed on the left surface 12L in FIG. 1A. Coil 16 is formed on the right surface 12R in FIG. 1B. Referring to FIG. 1B, matching coil 16 is shown formed on the right (opposite) side 12R of the thin plate 12 which is superimposed above coil 14 in FIG. 1C.

FIG. 1C is a perspective view of a fragment of the upper left corner of the vane 10 of FIG. 1B shown with a portion of a coil structure 16 seen on the right surface 12R of plate 12.

Referring again to FIG. 1A, instead of the coil structure 14 being wound in a conventional manner to form a bundle of copper wires as in Messick et al. U.S. Pat. No. 5,631,615, the coil structure 14 is formed in accordance with this invention. The coil structure 14 is formed as a single, planar layer of copper coil windings (preferably formed as a thick film layer) laminated to thin plate 12 (substrate), thereby forming a coil vane 10. The left side coil 14 begins at terminal 18A and spirals inwardly on the surface of the left side 12L of plate 12 until it reaches pad 14P in the interior of the left side coil 14 at via 18B. Note that via 18B is relatively close to terminal 18A. Pad 14P is connected to the left end of via 18B which passes through the plate 12 to the right side 12R of plate 12 where the right end of via 18B connects to the pad 16P at inner end of the right side coil 16.

Contact can be made to the coils 14 and 16 with contacts at the ends 18A and 18C of the interconnected spiral coils 14/16 as will be obvious to those skilled in the art. The right side coil 16 begins at terminal 16P and spirals outwardly on the surface of the right side 12R of plate 12 to terminal 18C. Referring to FIG. 1B, on the right side 12R of vane 10, pad 16P is connected to the right end of terminal via 18B. Via 18B connects through the plate 12 and the left end of terminal vie 18B connects to the pad 14P on the left side 12L of plate 12 as seen in FIG. 1A.

Figure 1D:
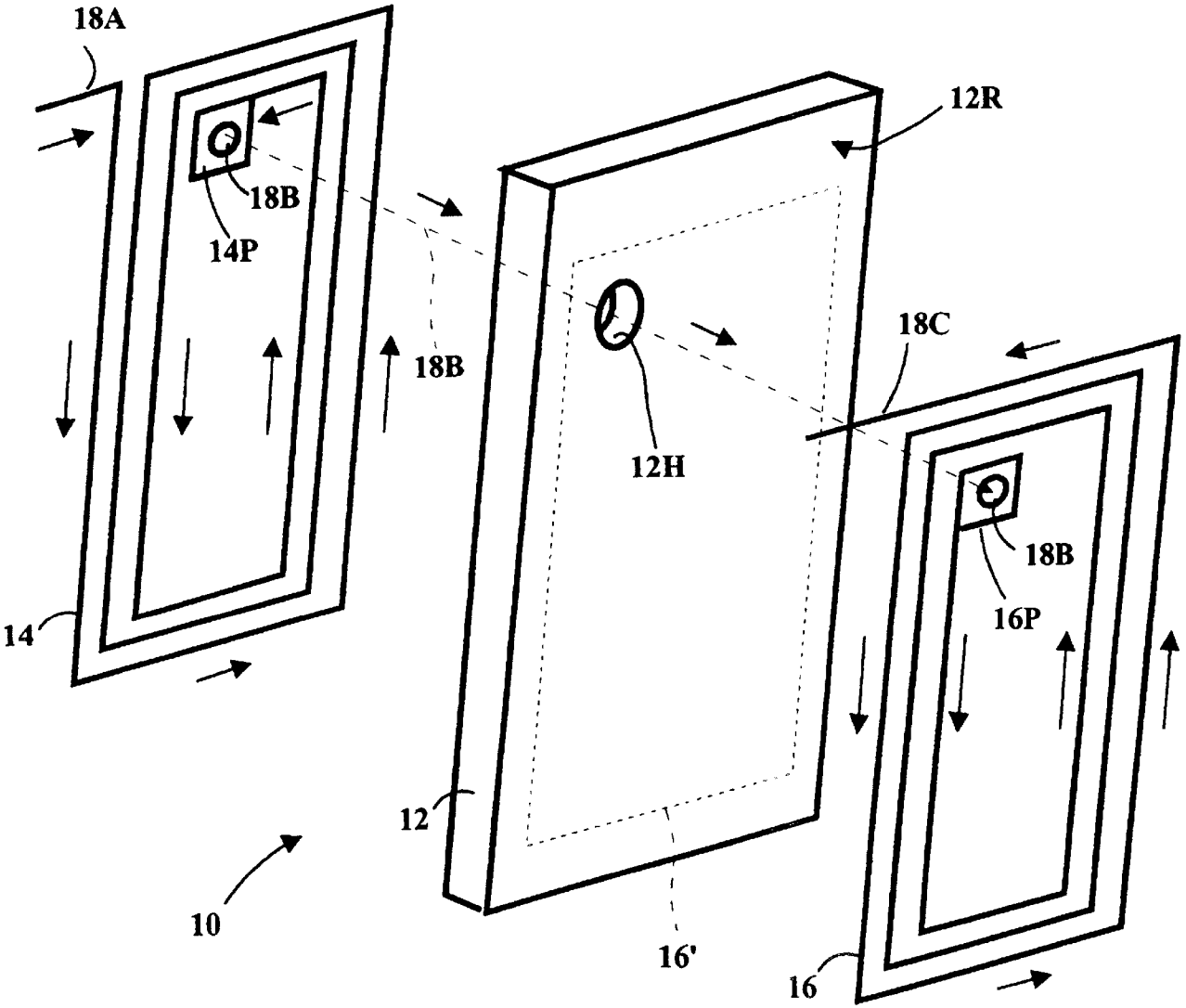
FIG. 1D is an isometric view of the vane of FIGS. 1A–1C with the coil structures and exploded away from the left and right surfaces of the plate.

FIG. 1D shows an isometric, perspective view of the coil structures 14 and 16 exploded away from the surfaces of plate 12. The phantom line 16' indicates where the coil 16 lies on plate 12. Several arrows indicate the direction of current flow through the coils 14 and 16. An arrow, at terminal 18A, shows current entering the upper left, outer corner of left side coil 14 on the left side of plate 12 (bottom surface) shown at the upper left at terminal 18A. Then, the current travels along a counterclockwise path to the inner end of spiral coil 14 at pad 14P. Then current travels through via 18B, through via hole 12H in plate 12 on up into contact with pad 16P on the right side (top surface) of plate 12. Then the current travels once again along a counterclockwise path to the outer end of spiral coil 16 to reach terminal 18C at the upper left, outer corner of right side coil 16. Thus the coils 14 and 16 are connected in series with the current flowing in the same direction in each coil. The superimposed coils 14 and 16 provide a cumulative magnetic field since the fields of the two coils are cumulative. The direction of current can be changed to clockwise which will again provide the same cumulative magnetic field from the superimposed coils 14 and 16.

Figure 2:
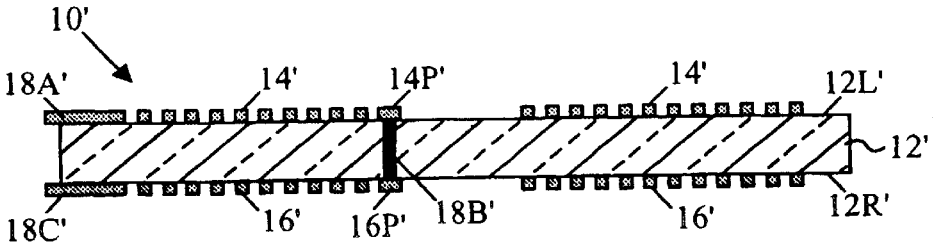
FIG. 2 shows a sectional view of an example of a coil vane made in accordance with the concept illustrated in FIG. 1, for use in a deflector in accordance with this invention.

FIG. 2 shows a sectional view of an example of a coil vane 10' made in accordance with the concept illustrated in FIGS 1A–1C with a larger number of turns of windings 14' and 16'. Winding 14' includes twelve turns of copper wiring on the left surface 12L' of thin plate 12'. Winding 16' is a matching, complementary coil winding of twelve turns of copper wiring on the right surface 12R' of thin plate 12'. Alternatives to copper metal for the coil windings 14' and 16' include the metals of gold, silver, alloys thereof, as well as other low resistance materials. The thin plate 12' is made from a material with a very low Coefficient of Thermal Expansion (CTE) such as quartz.

Figure 3:
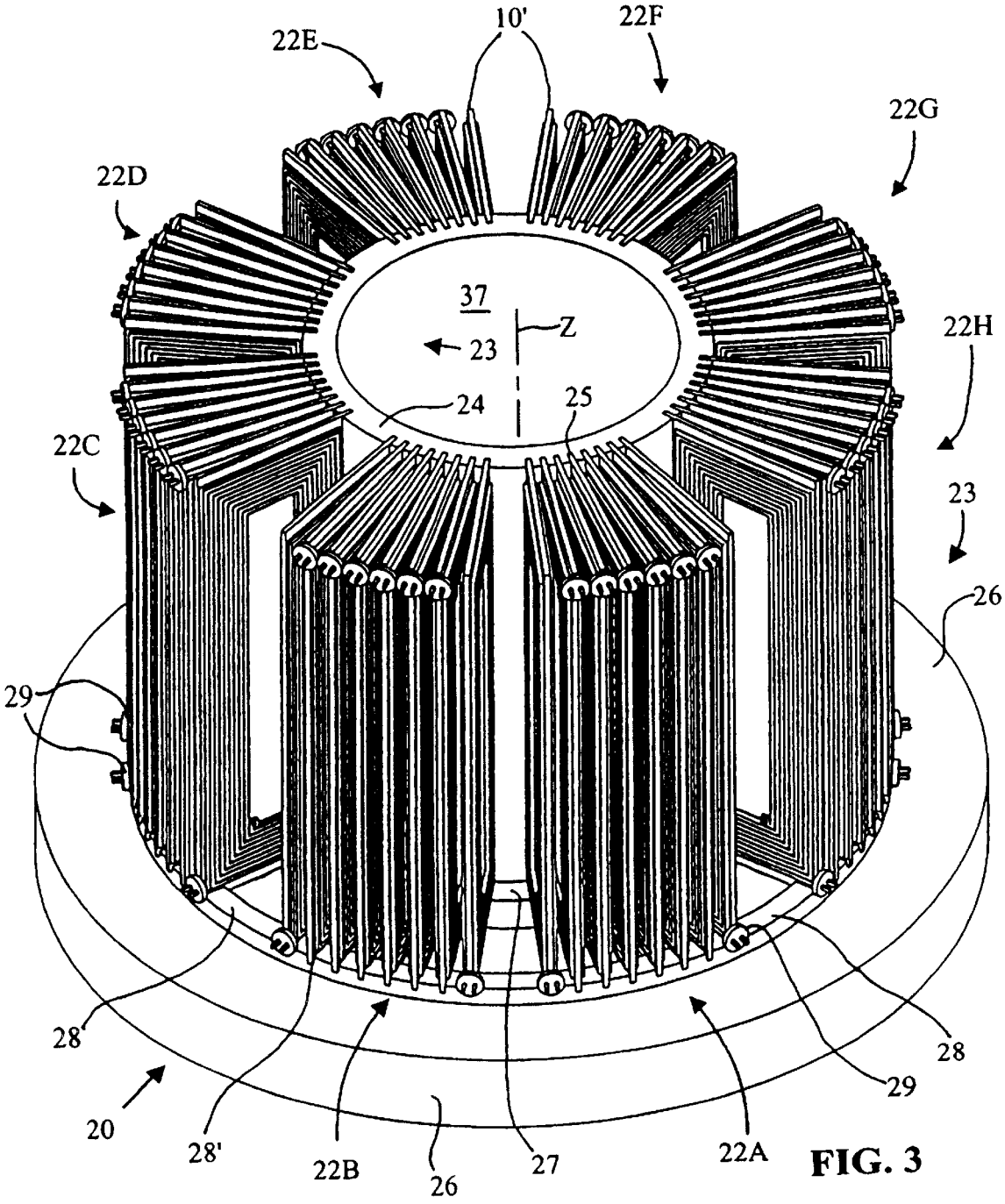
FIG. 3 shows an isometric view of a deflection yoke for a deflector in accordance with this invention incorporating the types of coil vanes seen in FIG. 2.

FIG. 3 is a partially schematic, perspective view showing an example of a practical embodiment in accordance with this invention, of a deflector 20 having eight vane sets 22A–22H supported in slotted surfaces of cylinder 24 and on grooved surfaces of flange 26 of a hub 23. Hub 23 includes a hollow quartz cylinder 24 bonded to a hollow quartz flange 26 at the base thereof. In the example seen in FIG. 3, there are 64 vanes with each of eight vane sets 22A–22H including eight vanes 10' (such as the vanes 10' shown in FIG. 2.) Each of the coil vanes 10' carries a pair of coils 14'/16' on left/right surfaces respectively of plates 12', as seen in FIG. 2, which are arranged on hub 23 spaced radially around the central, vertical, hollow, tubular cylinder 24 at the desired angular configuration and electrically connected to energize deflector 20. The vanes 10' of vane sets 22A–22H are rigidly supported by both the flange 26 and the cylinder 24 of the hub 23.

The hub 23 is formed by an upright, tubular cylinder 24 (with the usual longitudinal opening lengthwise of the cylinder 24) supported at its base upon a coaxial, hollow, cylindrical flange 26 (with an opening matching the opening lengthwise of the cylinder 24). An inner annular ring 27 is formed at the base of cylinder 24, where cylinder 24 meets the top surface of the flange 26. An outer annular ring 28 is formed on the top surface of the flange 26 below the outer edges of the vanes 10'.

On the deflector 20, each plate 12' (vane 10') is supported by cylinder 24 above the hollow disc-shaped flange 26 in grooves 27' on rings 27 and in grooves 28' on rings 28. The vertical edge of plate 12' is supported in a vertical exterior slot 25 in outer wall of cylinder 24 so that each inner, vertical edge of a plate 12' is retained in one of the vertical exterior slots 25 in the outer wall of cylindrical 24.

The exterior wall of cylindrical 24 is machined to form exterior slots 25 extending vertically, parallel to the vertical, Z-axis of cylinder 24, from top to bottom. The cross section of the slots 27' and 28' extend radially from the Z-axis. The exterior slots 25 are adapted to receive the inner edges of the vanes 10' to retain those inner edges of vanes 10' firmly in position. Thus each vane 10' has its inner edge of its plate 12' bonded securely in a vertically extending external radial slot 25 in the cylinder 24, so that each coil vane 10' is securely supported in a position on the inner edge thereof.

As stated above, the coaxial annular outer support ring 28 is located under the outer edges of the plates 12' of the vanes 10' on the surface of the flange 26. The bottom edge of each plate 12' is secured in the machined grooves 28' formed in the top surface of outer annular ring 28 and additional machined grooves 27' formed on the top surface of the inner annular ring 27, as will be well understood by those skilled in the art. Grooves 28' extend radially from the Z-axis with respect to the cylindrical flange 26 and are aligned with the vertical exterior slots 25 in cylinder 24. Alternatively, the grooves 28', the inner ring 27 and the outer ring 28 can be eliminated from the surface of flange 26; and, as and alternative thereto, grooves can be formed by machining the surface of flange 26. Thus, the vanes 10' are aligned radially from the central, Z-axis of cylinder 24 spaced around the periphery thereof and the lower edges of the plates 12' of vanes 10' are rigidly supported on the bottom edges thereof bonded into a groove 27' and an aligned groove 28'. The grooves 28' are spaced well apart spacing the vanes 10' away from adjacent vanes 10'. In summary, the inner edges of vanes 10' are supported rigidly by vertical slots 25. The bottom edges of vanes 10' are supported rigidly being bonded into grooves 28' or bonded into other grooves formed on the surface of flange 26 so that the vanes 10' are supported rigidly on the inner and bottom edges.

The deflector 20 is adapted for an E-beam to pass through the cylinder 24 generally parallel to the Z-axis along the length of an E-beam column, but spaced therefrom or crossing the Z-axis, as is well understood by those familiar with E-beam columns and those skilled in the E-beam systems art. The cylinder 24 is integral with and supported coaxially with the annular flange 26 which forms the base portion of the hub 23.

In this embodiment the cylinder 24 is formed of a crystal cylinder 24 which is bonded to the hollow quartz flange 26 by an optical adhesive such as an ultraviolet cured optical cement, as will be well understood by those skilled in the art.

An alternative to using annular rings 27 and 28 on the surface of flange 26 is simply to machine radial grooves in the surface of flange 26 to hold the lower edges of the plates 12' of vanes 10'.

Figure 4A:
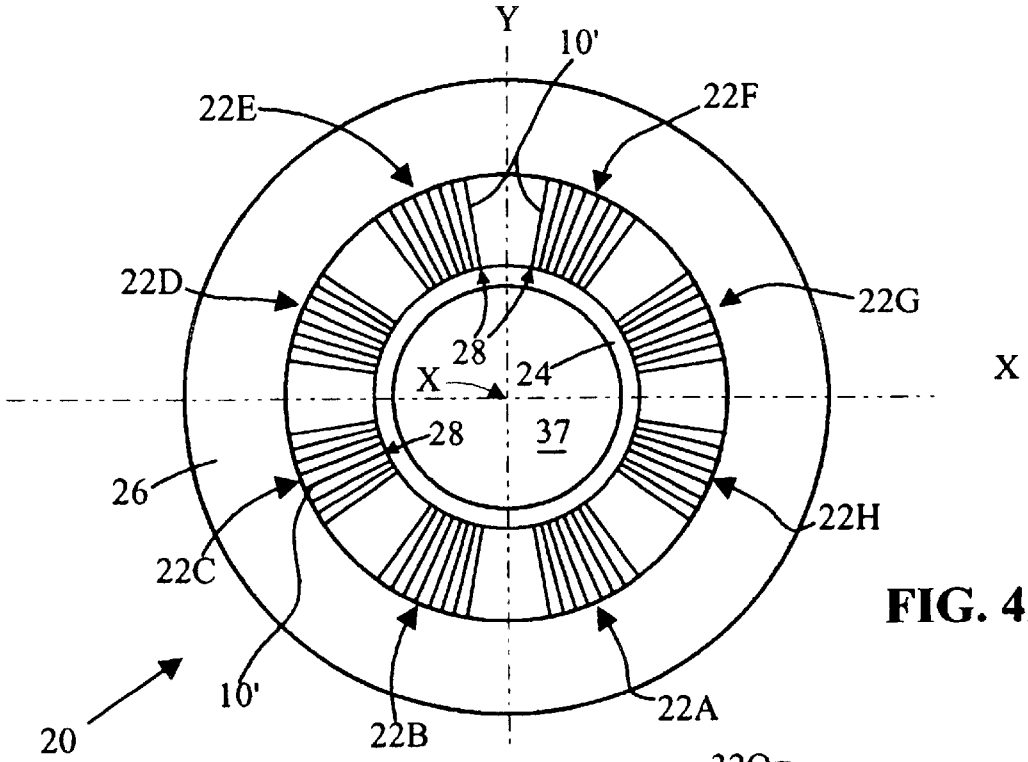
FIG. 4A shows a schematic diagram of a plan view of a deflector of the type shown in FIG. 3.

FIG. 4A shows a schematic diagram of a plan view of the deflector 20 of FIG. 3 showing the arrangement of eight vane sets 22A–22H with each of those vane sets including eight vanes 10'.

In the illustrative embodiment seen in FIG. 3 and and FIG. 4A the thickness of the plates 12' must be adjusted as a function of the number of vanes 10' needed to produce the required magnetic field. In some cases, numerous separate vanes 10' are required to generate the required magnetic field. For example, sixty-four vanes 10' are shown in FIG. 3 and FIG. 4, with eight clusters 22A–22H, with each cluster including eight vanes 10', as an illustrative embodiment for a case in which that many vanes 10' are needed to produce the required magnetic field. Smaller or larger numbers of vanes 10' can be used depending upon the number of ampere turns required. When larger numbers of plates 12' are employed that further constrains the thickness of the substrate plates 12' as the number of plates 12' increases.

Alternative materials to quartz for thin plates 12' are insulating substrates, which are stiff and mechanically stable during operation. Such insulators comprise ceramics and polymers such as polyimide.

Preferably the complementary coils 14' and 16' are copper coils formed on the surface of the thin quartz plate by the process steps as described in copending Pinckney et al. U.S. patent application Ser. No. 09/325,162 is incorporated herein by reference. In general the process involves bonding a copper sheet to a quartz substrate and then patterning the copper sheet by machining away unwanted copper.

This invention solves the problem and achieves the advantage that thermal stability of each coil 14'/16' is achieved by allowing the coolant to flow over each individual coil winding, and by constraining the expansion and contraction of the coil windings by bonding them to a low CTE plate 12'. The vanes 10' are in turn bonded to an assembly comprising the low CTE (quartz) cylinder 24 and disk shaped (quartz) flange 26 to form a complete deflection hub 23.

A further problem solved by this invention is that each coil 24/26 is now mounted on what is close to a truly radial alignment in the radial grooves 28' and slots 25 with respect to the central Z-axis of the cylinder 24 and flange 26 of hub 23, resulting in a four-fold reduction in optical aberrations.

The very large defection fields required for E-beam projection require an improved solution such as the one provided by this invention. The wiring is connected to the vanes at connectors 34 seen in FIG. 3 as illustrated schematically in FIGS. 5A and 5B.

FIG. 4A shows a schematic plan view of a deflector of the type shown in FIG. 3 with like numbers referring to like parts with the X axis horizontal, the Y axis vertical and the Z-axis into the page comprising the central axis of the deflector 20. FIG. 4A illustrates the placement of eight sets 22A–22H of eight vanes 10' each. The vanes 10' are secured in vertical slots 25 on the exterior surface central cylinder 23 of hub 23. Cylinder 24 is secured at its base to flange 26. Both cylinder 24 and flange 26 have a hollow cylindrical opening 37, through which the charged particles, e.g. electrons, pass towards a target (such as a semiconductor wafer not shown).

Figure 4B:
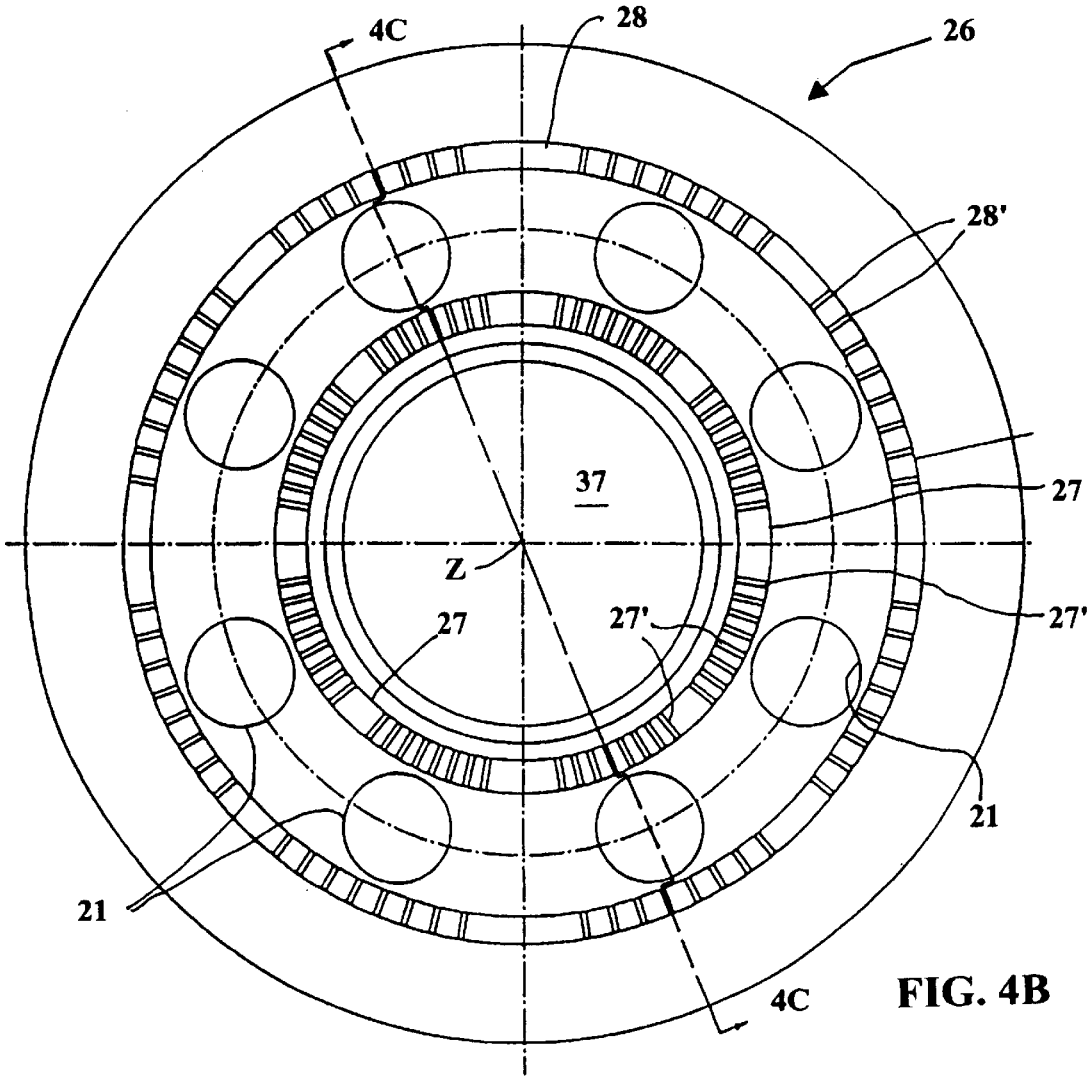
FIG. 4B shows a plan view of the flange at the base of the deflector of FIG. 4A
Figure 4C:
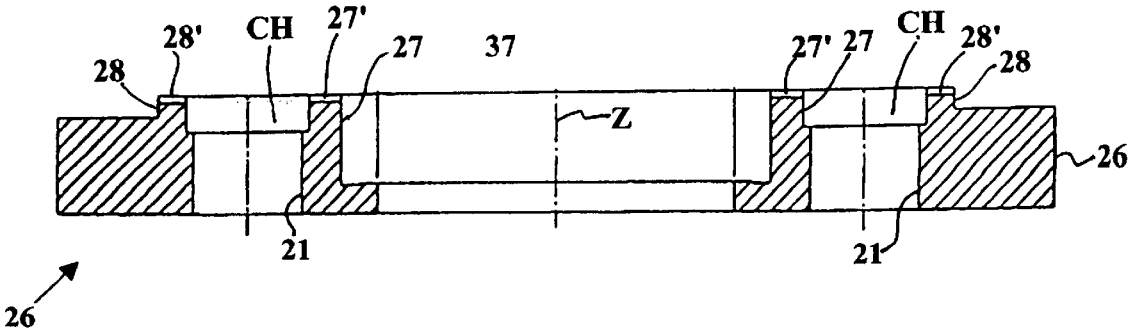
FIG. 4C shows a sectional elevation taken along line 4C—4C in FIG. 4B of the base of the deflector of FIG. 4A.

FIG. 4B shows a plan view of the flange 26 at the base of the deflector 20 of FIG. 4A. FIG. 4C shows a sectional elevation of the flange 26 taken along line 4C—4C in FIG. 4B. The coaxial, hollow, cylindrical flange 26 has a central opening 37 matching the opening 37 lengthwise of the cylinder 24.

The inner annular ring 27 is formed at the base of cylinder 24, where cylinder 24 meets the top surface of the flange 26. The coaxial annular inner support ring 27 formed on the top surface of flange 26 includes the grooves 27' machined on the top surface thereof.

The outer, coaxial, annular ring 28 is formed on the top surface of the flange 26 below the outer edges of the vanes 10'. The annular outer support ring 28 includes the machined grooves 28' formed in the top surface of outer annular ring 28.

Machined grooves 27' and grooves 28' extend radially from the Z axis above the cylindrical flange 26 in alignment with vertical exterior slots 25 in cylinder 24 to support the lower edges of the vanes 10'.

The grooves 28', the inner ring 27 and the outer ring 28 can be eliminated from the surface of flange 26; and, as and alternative thereto, grooves can be formed by machining the surface of flange 26.

Between the outer ring 28 and the inner ring 27 are a series of coolant holes 21 formed through flange 26 from the top surface of flange 26 to the bottom surface of flange 26. The coolant holes 21 permit coolant to circulate from the space below the bottom of flange 26 up towards the bottoms of the vanes 10' where it can pass between the vanes to cool the coils on the vanes . Note that the rings 27 and 28 form an annular channel CH which permits circulation of coolant from the coolant holes 21.

Figure 5A:
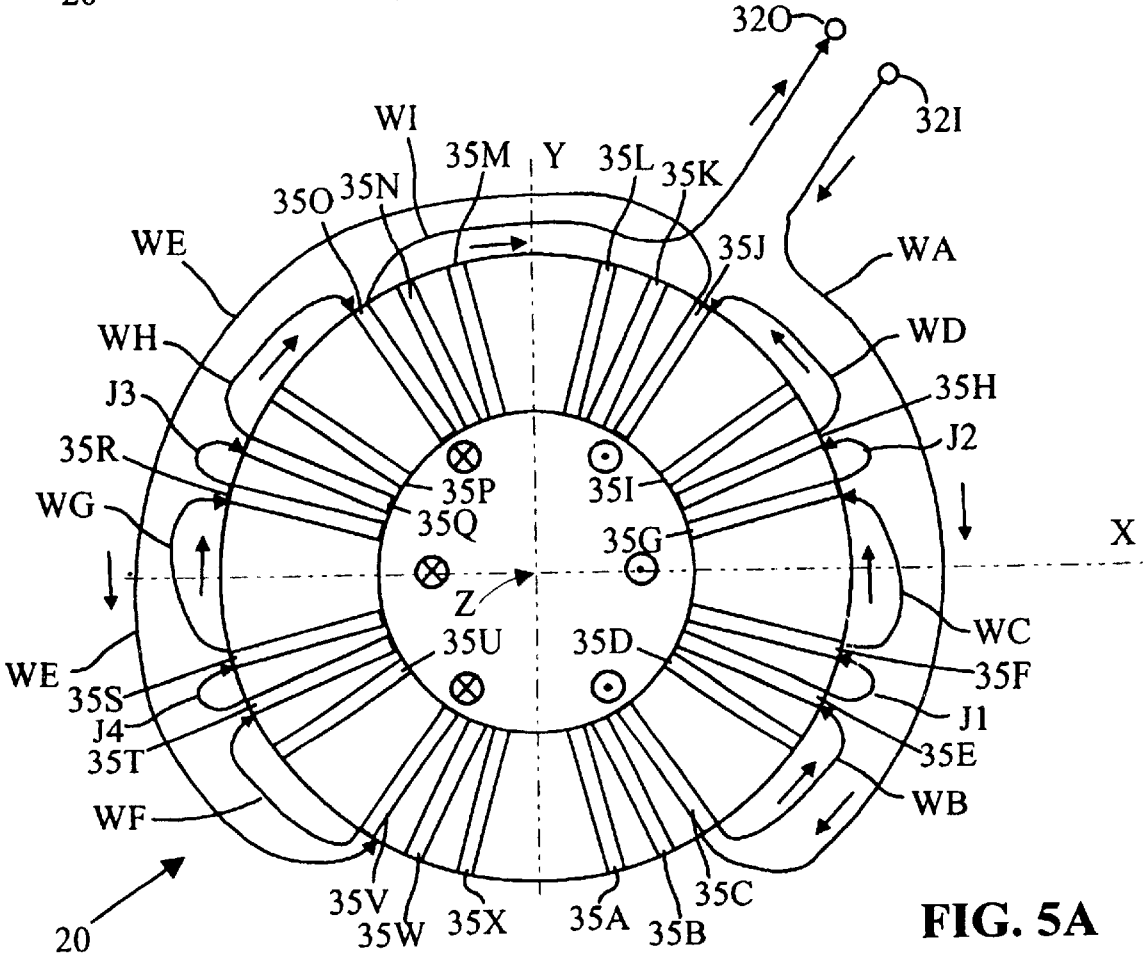
FIGS. 5A is a schematic diagram of a plan view of a deflector showing an example of an arrangement for connecting wiring to the windings of twelve of twenty-four vanes with eight sets of three vanes 35A–35X. Twelve of the twenty-four vanes shown in FIG. 5A represent the wiring connections for energizing the x-axis deflection.
Figure 5B:
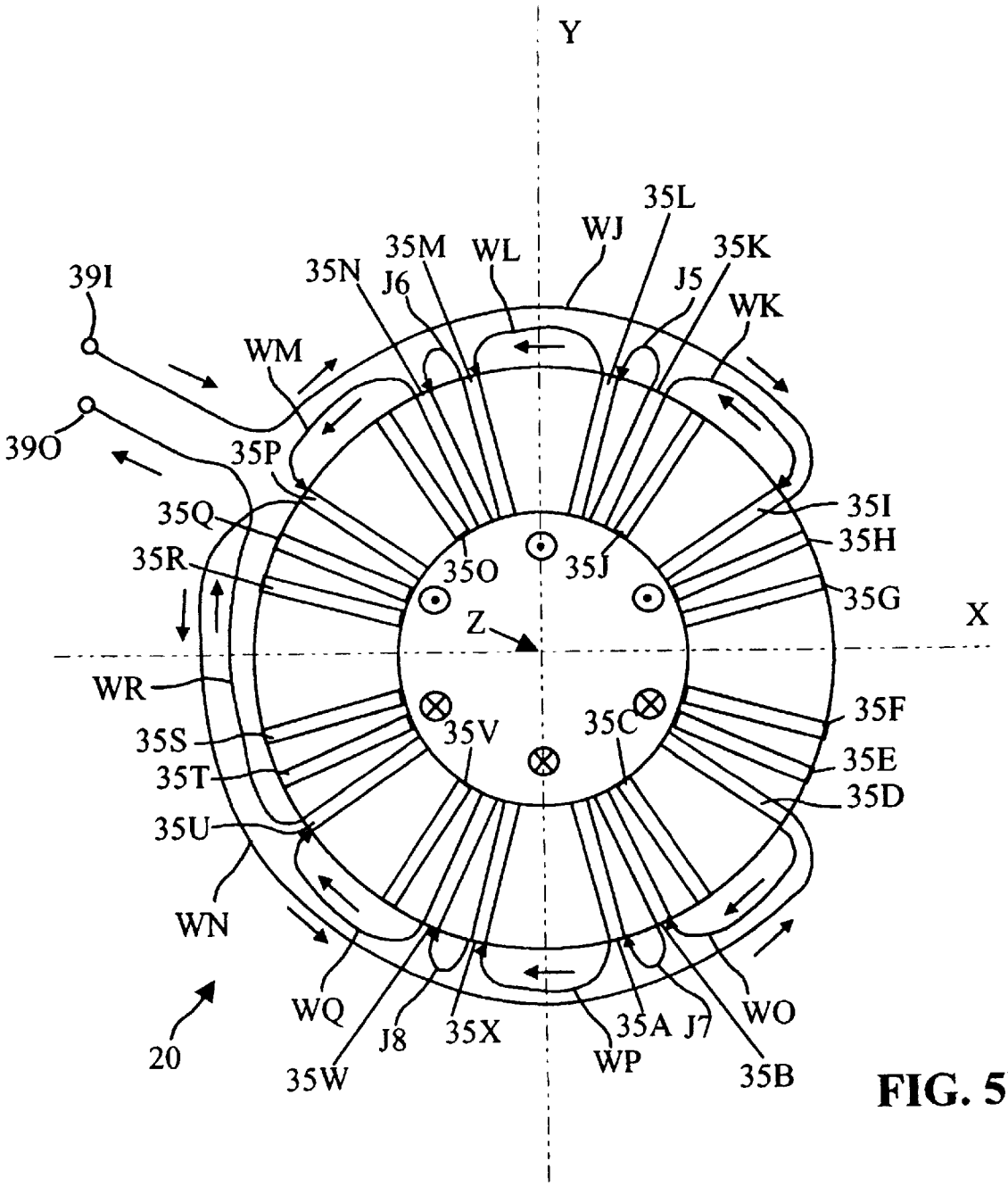
FIGS. 5B is a schematic diagram of a plan view of a deflector showing an example of an arrangement for connecting wiring to the windings of twelve of twenty-four vanes with eight sets of three vanes 35A–35X. The other twelve of the twenty-four vanes shown in FIG. 5B represent the wiring connections for energizing the y-axis deflection.

FIGS. 5A and 5B are schematic diagrams of a plan view of a twenty-four vane deflector 20 in accordance with this invention with the X axis horizontal, the Y axis vertical and the Z-axis into the page comprising the central axis of the deflector 20.

FIG. 5A shows the arrangement of connections of wiring to the windings of twelve of twenty-four vanes with eight sets of three vanes 35A–35X of three vanes per set for energizing the X-axis of deflection. The direction of current flow is indicated by the arrows shown in FIG. 5A to be out of output line 32O and into input line 32I.

FIG. 5B shows the connections to the other twelve vanes of the twenty-four vanes seen in FIGS. 5A and 5B for energizing the Y-axis of deflection.

Windings for FIG. 5B were omitted from FIG. 5A for clarity of understanding and convenience of illustration. Similarly, the windings for FIG. 5A were omitted from FIG. 5B for clarity of understanding and convenience of illustration. Actually in an embodiment of this invention, the windings of FIGS. 5A and 5B are superimposed, as will be well understood by those skilled in the art.

Referring again to FIGS. 5A, on the connections to a selected vane 35C of a first set of vanes 35A, 35B and 35C and two selected vanes 35E and 35F of a second set of vanes 35D, 35E and 35F are illustrative of one way of connecting current to one quadrant of vanes 35C, 35E and 35F. Current enters on input connection line 32I which is connected via wrap around wire WA to the lower side of vane 35C which is in the lower right quadrant in FIG. 5A, referred to hereinafter as the first quadrant. The complementary coil on the upper side of vane 35C connects to the wire WB which connects to the lower side of vane 35E. The complementary coil on the upper side of vane 35E connects via jumper wire J1 to the lower side of coil 35F. The complementary coil on the upper side of vane 35F connects to the wire WC. The direction of current flow is indicated by the arrows shown in FIG. 5A to be counterclockwise except for wire WA, which is clockwise and parallel to the wires WB-WD and jumpers J1 and J2, some of which are described above and some of which are described below.

In the second quadrant on the upper right of FIG. 5A, wire WC connects to the lower vanes 35G, 35H of a third set of vanes 35G, 35H and 35I and one selected vane 35J of the fourth set of vanes 35J, 35K and 35L illustrates further connections to vanes 35G, 35H and 35J. Current enters on wire WC which is connected to the lower side of vane 35G. The complementary coil on the upper side of vane 35G connects to the jumper J2 which connects to the lower side of vane 35H. The complementary coil on the upper side of vane 35H connects via wire WD to the lower side of coil 35J. The complementary coil on the upper side of vane 35J connects to the long wrap around wire WE which reaches around to the fourth quadrant on the lower left of FIG. 5A. The direction of current flow is indicated by the arrows shown in FIG. 5A to be counterclockwise.

Connection is made to vane 35V of an eighth set of vanes 35V, 35W and 35X and two selected vanes 35S and 35T of a seventh set of vanes 35S, 35T and 35U illustrating further connections to vanes 35V, 35T and 35U. Current enters the fourth quadrant on wrap around line WE which is connected to the lower side of vane 35V. The complementary coil on the upper side of vane 35V connects to the wire J4 which connects to the lower side of vane 35T. The complementary coil on the upper side of vane 35T connects via jumper J4 to the lower side of coil 35S. The complementary coil on the upper side of vane 35S connects to the wire WG. The direction of current flow is indicated by the arrows shown in FIG. 5A to be counterclockwise for wrap around wire WE but clockwise for wires SF, J4 and WG.

Connections to vanes 35R and 35Q of an sixth set of vanes 35R, 35Q and 35P and a selected vane 35O of a fifth set of vanes 35O, 35N and 35M illustrate further connections to vanes 35R, 35Q and 35O. Current enters on wire WG which is connected to the lower side of vane 35R. The complementary coil on the upper side of vane 35R connects to the jumper wire J3 which connects to the lower side of vane 35Q. The complementary coil on the upper side of vane 35Q connects via wire WH to the lower side of coil 35O. The complementary coil on the upper side of vane 35O connects to wire WI which connects to the output line 32O. Again, the direction of current flow is indicated by the arrows shown in FIG. 5A to be out of output line 32O and into input line 32I. The direction of current flow between vanes 35S to 35V is indicated by the arrows shown in FIG. 5A to be counterclockwise for wrap around wire WE but clockwise for wires WG, J3, WH and WI which are parallel to input line 32I. As shown by the tails of arrows on the left side within the inner circle in FIG. 5A, it can be seen that the magnetic field is directed (into the page (normal to the page) on the left side of the drawing and it can also be seen, as shown by the points of arrows on the right side within the inner circle in FIG. 5A, that the magnetic field is directed out of the page on the right side of the drawing as required for a deflection yoke. Reversing the coil current direction will reverse the deflection direction and the fields as shown as will be understood by those skilled in the art.

FIGS. 5B is a schematic diagram of a plan view of a deflector 20 illustrating the arrangement of connections of wiring to the windings of twelve of twenty-four vanes with eight sets of three vanes 35A–35X of three vanes per set for energizing the Y-axis of deflection. The difference from FIG. 5A is that the connections are rotated by ninety degrees to be centered on the Y axis.

CANCELLATION OF STRAY MAGNETIC FIELDS FROM WIRING

Wiring employed to make connections to the devices FIGS. 3, 5A and 5B is preferably done by use of twisted pair wiring to cancel out magnetic fields between clusters of vanes 10' and 35A–35X and to cancel out magnetic fields generated by the wires WA to WR and 32I and 32O and the jumper wires J1 to J8.

STIGMATORS

In addition to the above application of the design of this invention, stigmators can be provided in the structure by adding additional vanes 10' or 35 where desired inserted between clusters of coils of the kind shown and described above. The stigmators will be wired separately, as will be well understood by those skilled in the art.

VANE STRUCTURE

In cases where lower currents are permissible, instead of quartz, the plates (substrate) 12' (FIG. 2) can be composed of a ceramic material upon which conductors 14'/16' can be plated into the form of the complementary coils.

METHOD OF FORMING DEFLECTOR

The quartz cylinder 24 is made by machining vertical slots 25 parallel to the Z-axis in the exterior of the cylinder 24. A matching quartz flange 26 is made with radial grooves etc. machined on the surface of the flange 26 (FIG. 3) or on the surface of ring 27 (grooves 27') and the ring 28 (grooves 28') formed on the top surface of the flange 26. The flange 26 and the cylinder 24 are bonded together with an optical adhesive, which is preferably an ultraviolet cured cement.

As will be manifest to those skilled in the art, the effect of the wiring in FIG. 5B is directly analogous to the description found for FIG. 5A and thus further description is believed to be manifest from the drawings and the above description of FIG. 5A.

Figure 6:
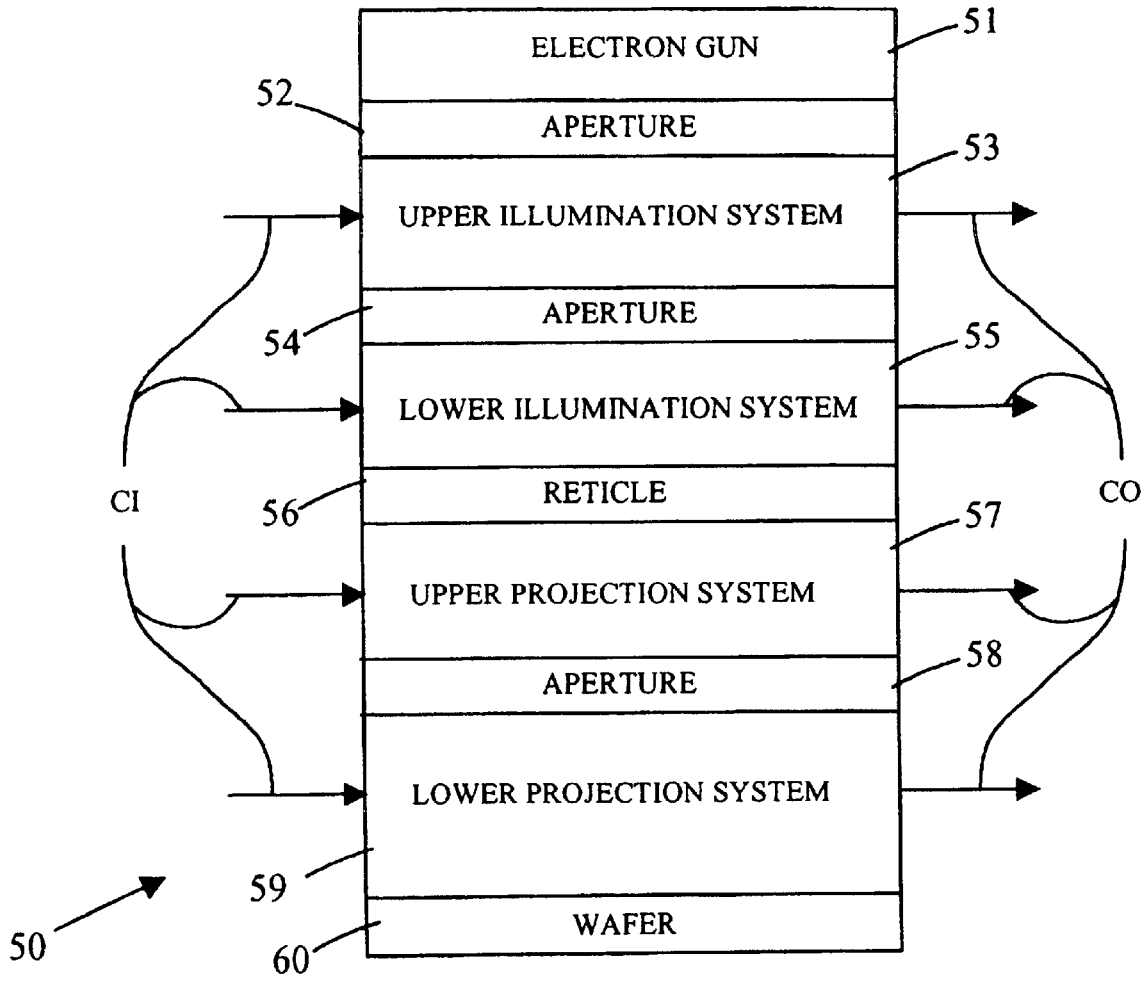
FIG. 6 shows a schematic block diagram of an E-beam column for an E-beam projection system adapted for use of several pairs of yokes in accordance with this invention in the illumination systems as well as the projection systems of an EBPS.

FIG. 6 shows a schematic block diagram of an E-beam column for an E-beam projection system adapted for use of several pairs of deflectors 20 (FIGS. 3, 4A–4C, 5A, 5B) in accordance with this invention in the illumination systems 53 and 55 as well as the projection systems 57 and 59 of an EBPS. An electron gun 51 provides an E-beam which is directed towards a wafer 60 through an aperture 52 through upper illumination system 53. The E-beam passes from upper illumination system 53 through aperture 54 and lower illumination system 55 for illumination of reticle 56. The images from reticle 56 are projected through upper projection system 57, aperture 58 and lower projection system 59 to expose wafer 60 with the image from the reticle 56.

Figure 7A:
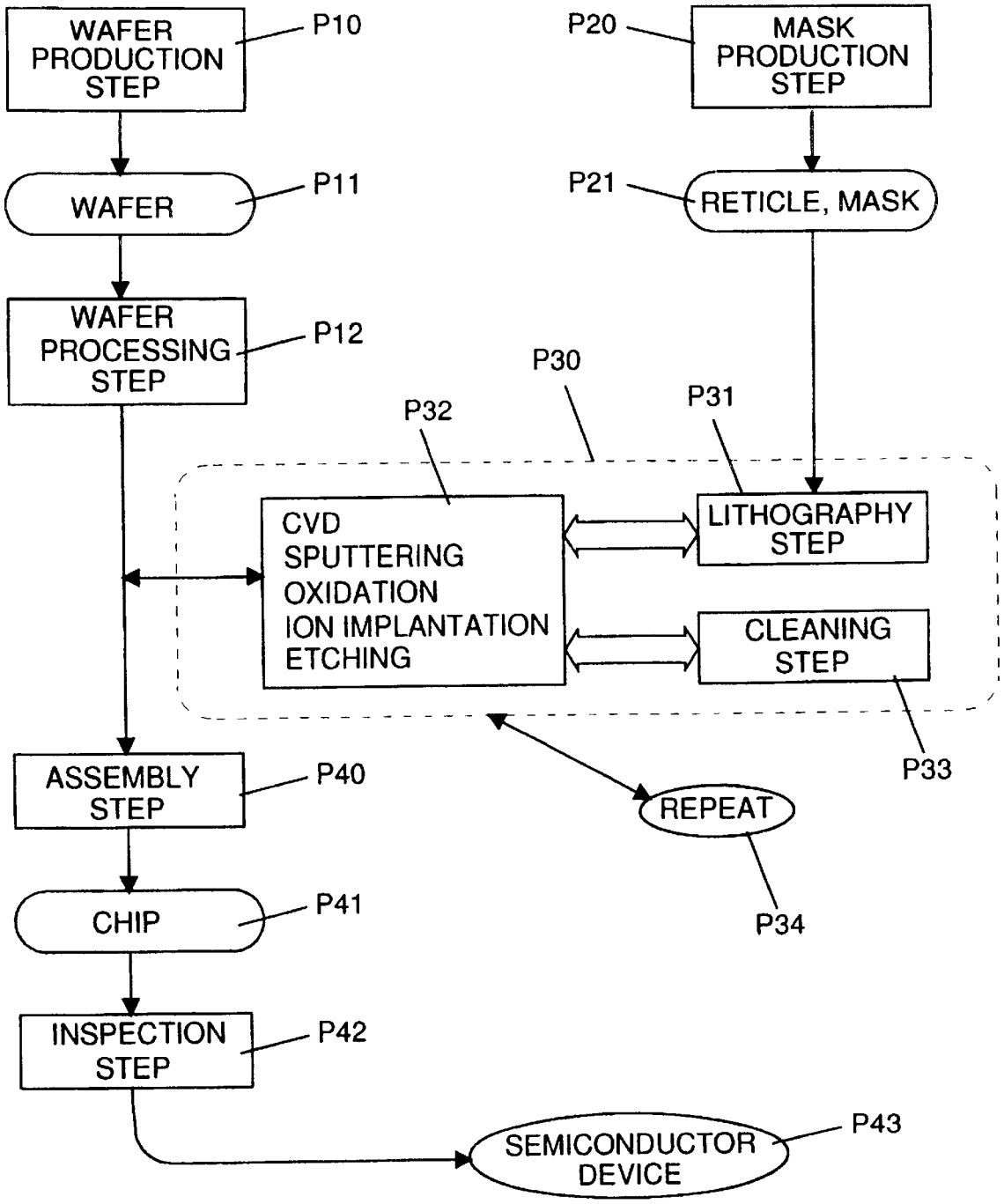
FIG. 7A shows a schematic block diagram of a process for manufacture of a semiconductor chip employing the tool of this invention for manufacture of a semiconductor chips.

The system of FIG. 6 can be employed as a semiconductor manufacturing tool as will be well understood by those skilled in the art of semiconductor manufacturing. As an example, FIG. 7A shows a schematic block diagram of a process for manufacture of a semiconductor chip. FIG. 7A shows an example of a flow chart of semiconductor fabrication method to which the apparatus of this invention can be applied easily employing the deflector of this invention. The semiconductor fabrication method comprises mainly a wafer production step P10 (or wafer preparation step) which produces a finished wafer in step P11, a mask production step P20 (or mask preparation step) which produces a finished reticle, mask in step P21, a wafer processing step P12, an assembly step P40 yielding a chip P41 and an inspection step P42. Each step comprises several substeps as will be well understood by those skilled in the art. Among these main steps, the wafer processing step P12 is a most important step to achieve the specified finest pattern width and registration limit. In this step, the designed circuit patterns are stacked successively on the wafer from step P11 and many operative semiconductor chips like memory devices or MPC are formed on the wafer from step P11.

The wafer processing steps P12 comprises a step of thin film formation wherein a dielectric layer for insulation is formed or a metal layer for lead lines and for electrodes is formed. An oxidization step can be employed to oxidize the thin film or the wafer substrate. A lithography step P31 involves use of the reticle/mask P21 to form a photoresist or other resist pattern to process the thin film or wafer substrate selectively, a selected set of process steps P32 including etching the thin film or wafer substrate and implanting ions or impurities into the thin film or wafer substrate using the resist pattern from step P31 as a mask. There is the conventional resist stripping step to remove the resist from the wafer and chip inspection step. As indicated at P34, the wafer processing steps P30 are repeated as many times as necessary to make a semiconductor chip be operable as designed, as will be well understood by those skilled in the art.

Figure 7B:
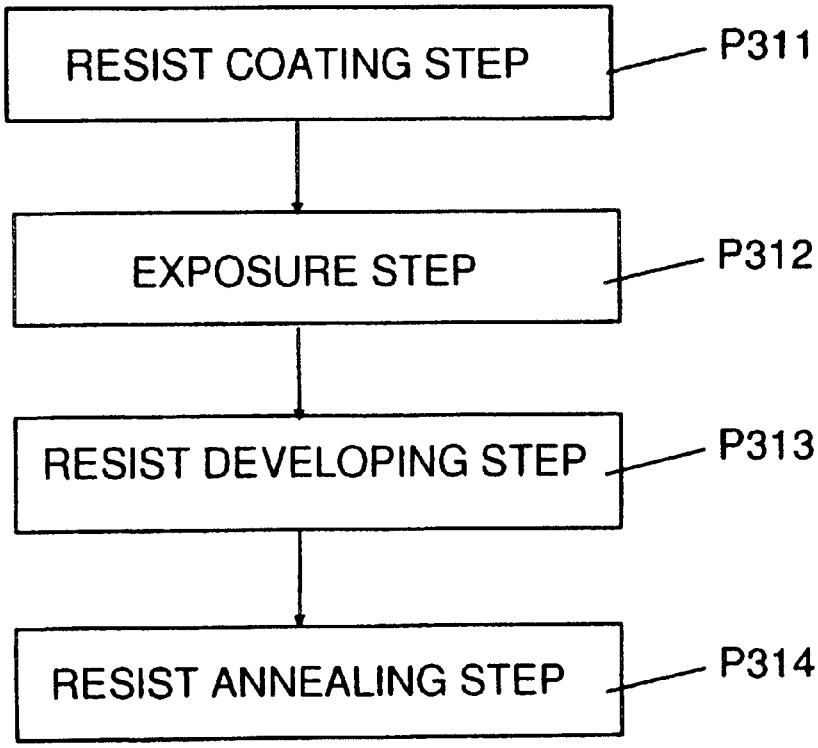
FIG. 7B shows a flow chart of lithography steps which are dominant steps in the wafer processing steps of FIG. 7A.

FIG. 7B shows a flow chart of lithography steps P31 of FIG. 7A which are dominant steps in the wafer processing steps P12/P30. Lithography steps P31 comprise a resist-coat step P311 in which the wafer substrate is coated with resist on circuit elements formed in a previous steps. An exposure step P312 then exposes the wafer coated with resist through the reticle/mask of step P21 employing a deflector in accordance with this invention. A resist development step P313 follows for developing the resist exposed in exposure step P312 followed by a resist annealing step P314 performed to enhance durability of the resist pattern produced in step P313.

Figure 8:
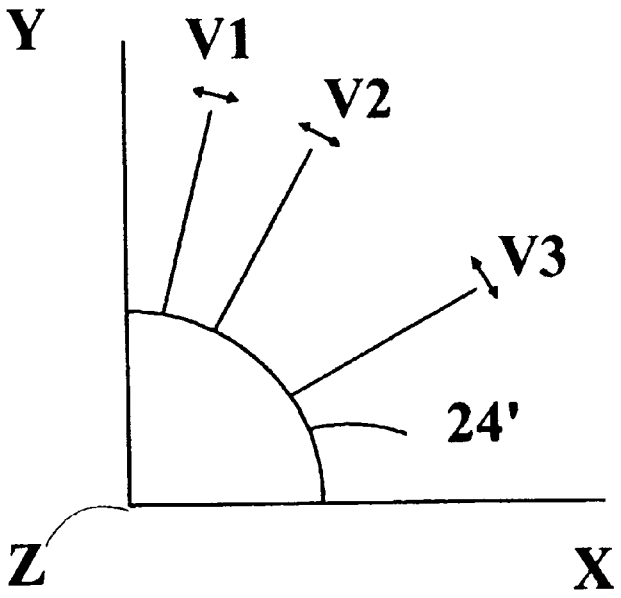
FIG. 8 shows a quadrant of a hollow cylinder with vanes.

FIG. 8 shows a quadrant of a hollow, cylinder 24' of a deflector 20' with 3 vanes V1, V2, and V3 which are shown with arrows indicating possible shifting of the locations of the vanes V1, V2, and V3 about the periphery of the cylinder 24' which can lead to aberrations.

The above described type of deflector can be applied in a system of the kind described above. The result is that particle beam systems employing the a defector in accordance with this invention can produce enhanced manufacturing capability for production (fabrication) of semiconductor devices. Similarly, this invention provides a very significantly improved semiconductor fabrication method. The results include achievement of the finest of patterns with an enhanced throughput (i.e. high productivity) with good registration, reduced-cost, and an enhanced footprint.

While this invention has been described in terms of the above specific embodiments), those skilled in the art will recognize that the invention can be practiced with modifications within the spirit and scope of the appended claims, i.e. that changes can be made in form and detail, without departing from the spirit and scope of the invention. Accordingly all such changes come within the purview of the present invention and the invention encompasses the subject matter of the claims which follow.

Having thus described the invention, what is claimed as new and desirable to be secured by Letters Patent is as follows:

1. In a deflector the improvement comprising:

a frame for a magnetic deflection coil comprising a cylinder with an opening for permitng a charged particle beam to pass therethrough towards a target, said frame including a plurality of deflection coil vanes supported on said frame, each of said vanes including a thin substrate which has a left surface and a right surface, and an electrical coil wound as a planar spiral on at least one of said left surface and said right surface.

2. A deflector in accordance with claim 1 wherein said thin substrate of each of said vanes is composed of a rigid insulating material.

3. A deflector in accordance with claim 1 wherein:

said thin substrate of each of said vanes is composed of a low Coefficient of Thermal Expansion (CTE) plate and said electrical coil is composed of copper bonded to said low CTE plate.

4. A deflector in accordance with claim 1 wherein electrical coils are formed on both said left surface and said right surface of said substrate.

5. A deflector in accordance with claim 1 wherein:

said substrate comprises a quartz plate, said electrical coil is composed of copper bonded to said quartz plate, and electrical coils are formed on both said left surface and said right surface of said substrate.

6. A deflector in accordance with claim 1 wherein:

electrical coils are formed on both said left surface and said right surface of said substrate, said substrate comprises a quartz plate, said electrical coils are composed of copper bonded to said quartz plate, and said electrical coils are interconnected by an electrical via connection passing through said quartz plate.

7. A deflector in accordance with claim 6 wherein said thin substrate is composed of a rigid insulating material.

8. A deflector in accordance with claim 1 wherein said cylinder is formed on a cylindrical flange, with said opening extending through said cylindrical flange.

9. A deflector in accordance with claim 1 wherein:

said cylinder is formed on a cylindrical flange, with said opening extending through said cylindrical flange, electrical coils are formed on both said left surface and said right surface of said substrate, said substrate comprises a quartz plate and said electrical coils are composed of copper bonded to said quartz plate, and said electrical coils are interconnected by an electrical via connection passing through said quartz plate.

10. A deflector in accordance with claim 1 wherein:

electrical coils are formed on both said left surface and said right surface of said substrate, said coils are interconnected by an electrical via connection passing through said substrate, said cylinder is formed on a coaxial cylindrical flange, with said opening extending through said cylindrical flange, said substrate comprises a quartz plate and said coils are composed of copper bonded to said quartz plate, and said coils are interconnected by an electrical via connection passing through said quartz plate.

11. A deflector in accordance with claim 1 wherein said thin substrate is composed of quartz.

12. A deflector in accordance with claim 1 wherein said substrate comprises a quartz plate and said coil is composed of copper bonded to said quartz plate.

13. A deflector in accordance with claim 1 wherein coils are formed on both said left surface and said right surface of said substrate.

14. In a deflector, the improvement comprising:

a hub for a magnetic deflection coil comprising a cylinder formed on a cylindrical flange, said cylinder and said flange forming an opening for permitting a charged particle beam to pass therethrough towards a target, said hub including a plurality of deflection coil vanes supported on said hub, each of said vanes including a substrate which has a left surface and a right surface, an electrical coil wound as a planar spiral on said left surface of said vane, a complementary electrical coil wound as a planar spiral on said right surface of said vane, and said electrical coils being interconnected.

15. In a deflector, the improvement comprising a hub for a magnetic deflection coil comprising a cylinder formed on a cylindrical flange, said cylinder and said flange forming an opening for a charged particle beam to pass therethrough towards a target, said hub including a plurality of deflection coil vanes supported on said hub, each of said vanes including a substrate which has a left surface and a right surface, an electrical coil wound as a planar spiral on said left surface of said vane, a complementary electrical coil wound as a planar spiral on said right surface of said vane, and said electrical coils being interconnected by an electrical via connection passing through said quartz plate.

16. A deflector in accordance with claim 15 wherein:

said cylinder is a quartz cylinder with slots manufactured in the exterior of said cylinder, and said flange is a quartz flange with grooves manufactured in the top of said flange for holding said vanes in alignment.

17. The deflector of claim 16 wherein coolant holes are formed in said flange juxtaposed with the edges of said vanes.

18. A deflector in accordance with claim 15 wherein:

said said cylinder, which is composed of quartz, and said flange which is composed of quartz have matching slots and grooves, with slots manufactured in the exterior of said cylinder and grooves manufactured in the top of said flange for holding said vanes in alignment, and said quartz cylinder and said quartz flange are bonded together with an optical adhesive material.

19. The deflector of claim 18 wherein coolant holes are formed in said flange juxtaposed with the edges of said vanes and concentric annular rings are formed on the surface of said flange providing space for coolant circulation from said coolant holes to spaces between said flange and said vanes.

20. A method of manufacture of a semiconductor manufacturing tool for charged particle lithography systems the improvement comprising:

making a frame for a magnetic deflection coil comprising a cylinder with an opening for permitting a charged particle beam to pass therethrough towards a target, mounting deflection coil vanes supported on said frame, each of said vanes including a thin substrate which has a left surface and a right surface, and forming an electrical coil wound as a planar spiral on at least one of said left surface and said right surface.

21. A method of manufacture of a semiconductor manufacturing tool for charged particle lithography systems the improvement comprising:

making a hub for a magnetic deflection coil comprising a tubular cylinder and a coaxially aligned mounting flange by the steps of forming a tubular, quartz cylinder with an opening for permiting a charged particle beam to pass therethrough towards a target, and making longitudinal slots in the exterior surface of said cylindrical quartz element, and making a hollow, quartz mounting flange with radial grooves on the top surface thereof for accepting the lower edges of deflection vanes, and bonding said cylindrical quartz element to said quartz mounting flange with said hollow of said flange below said opening through said tubular cylinder, and aligning said slots in said exterior surface of said tubular cylinder with said radial grooves for accepting a deflection vane in said aligned slots and grooves.

22. A method in accordance with claim 21 including:

mounting a plurality of deflection coil vanes supported on said hub, forming each of said vanes of a thin substrate which has a left surface and a right surface, and forming an electrical coil wound as a planar spiral on at least one of said left surface and said right surface.

23. The method of claim 22 including the step of forming coolant holes in said flange juxtaposed with the edges of said vanes.

24. A semiconductor fabrication method comprising:

fabricating a wafer, fabricating a mask, processing said wafer, performing an assembly step, performing an inspection step, said method being characterized in that said wafer processing step includes a charged particle exposure apparatus wherein:

providing to said charged particle exposure apparatus a deflector with a yoke for a magnetic deflection coil comprising a cylinder with an opening for permitting a charged particle beam to pass therethrough towards a target, providing said yoke with a plurality of deflection coil vanes supported on said yoke, providing each of said vanes with a thin substrate which has a left surface and a right surface, and winding an electrical coil as a planar spiral on at least one of said left surface and said right surface.

25. The method of claim 24 including:

preparing a wafer, performing mask production by the steps as follows:

preparing a mask, wafer processing, assembly and inspection, each of said steps comprising several substeps including steps of wafer processing to achieve a specified finest pattern width and registration limit whereby designed circuit patterns are stacked successively on the wafer and many operative semiconductor chips are formed on the wafer, said wafer processing step comprising a step of forming a thin film including as follows:

formation of a dielectric layer for insulation or a metal layer for lead line and for an electrode, performing an oxidization step to oxidize a thin film or wafer substrate, performing a lithography step to form a resist pattern to process the thin film or wafer substrate selectively, and performing a processing step to etch the thin film or wafer substrate and to implant the ion or impurity into the thin film or wafer substrate using the resist pattern as a mask, performing a resist stripping step to remove the resist from the wafer and chip inspection step, repeating said wafer processing step as many times until said semiconductor chips are operable as designed.

* * * * *